United States Patent [19]

Kraeutler

[11] Patent Number: 5,072,767

[45] Date of Patent: Dec. 17, 1991

[54] DEVICE FOR FACILITATING THE FOLDING OF A RAISABLE CURTAIN

[75] Inventor: Bernard Kraeutler, Dunieres, France

[73] Assignee: Nergeco (SA), Dunieres, France

[21] Appl. No.: 566,623

[22] Filed: Aug. 10, 1990

[30] Foreign Application Priority Data

Aug. 11, 1989 [FR] France ..... 89-10803

[51] Int. Cl.[5] ..... A47H 5/00

[52] U.S. Cl. ..... 160/84.1; 160/348

[58] Field of Search ..... 160/84.1, 348

[56] References Cited

U.S. PATENT DOCUMENTS 2,648,379 8/1953 Bishop ..... 160/348 X 4,727,919 3/1988 Kraeutler ..... 160/84.1

4,921,032 5/1990 May ..... 160/84.1

*Primary Examiner*—Carl D. Friedman

*Assistant Examiner*—Derek J. Berger

*Attorney, Agent, or Firm*—Iandiorio & Dingman

[57] ABSTRACT

A goods-handling door comprises a raisable curtain 1 which folds concertina-like and which is stiffened by reinforcing bars 2 having rings 4 through which lifting straps 3 are passed, which straps are wound onto a top shaft 5. During lifting and while the curtain is folding, it is desirable for the curtain to fold regularly and in a preferred direction. Flexible and inextensible elements 11 are placed between adjacent bars in order to limit the spacing between the bars, and they are given a structure which facilitates folding in the desired direction.

8 Claims, 2 Drawing Sheets

FIG. 2
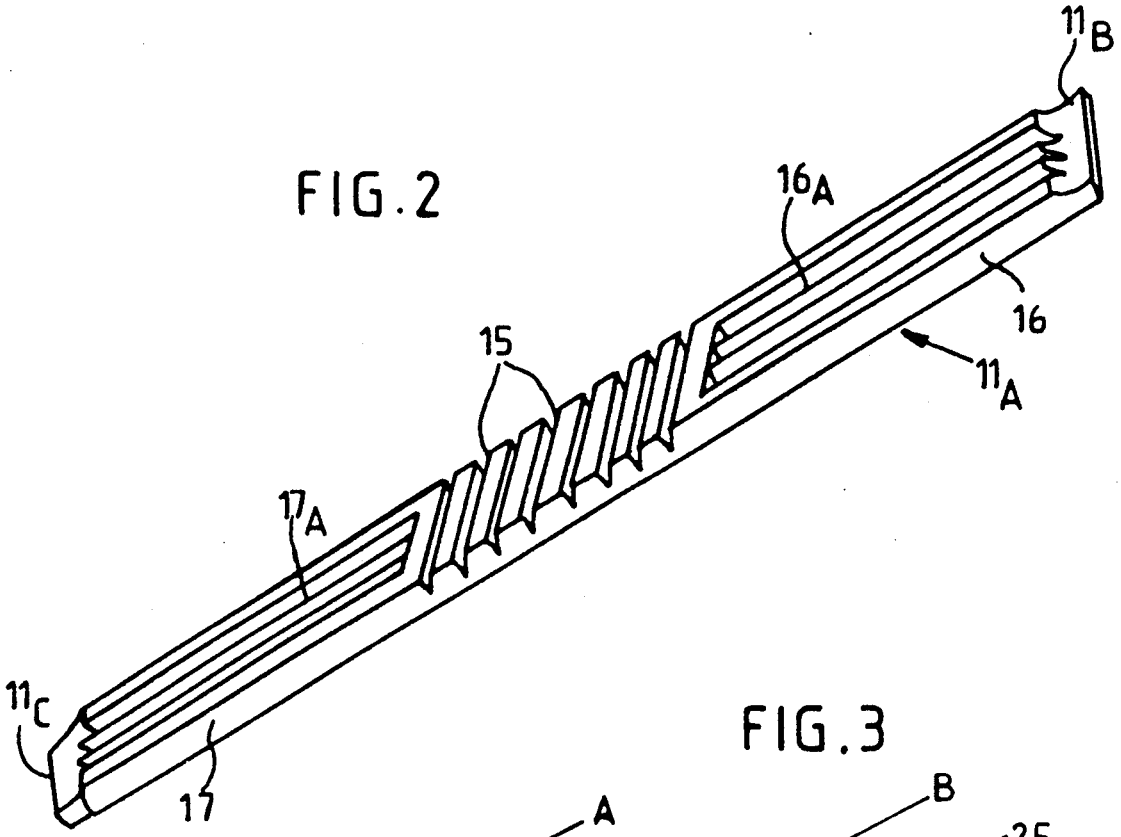
FIG. 3
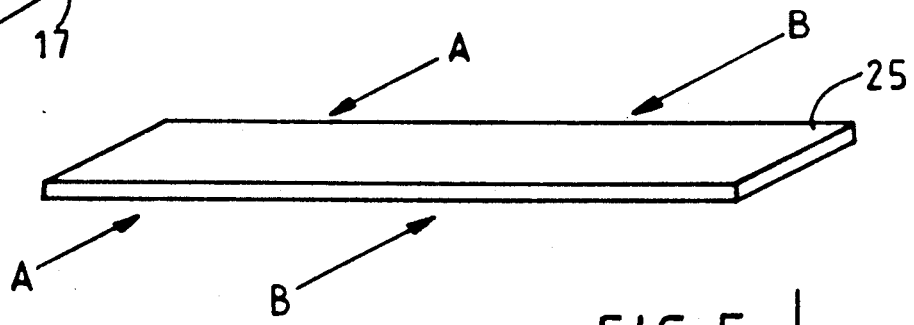
FIG. 5
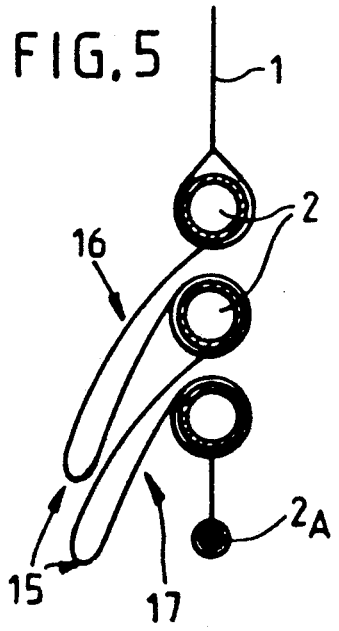
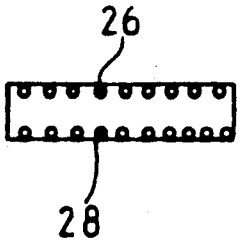
FIG. 4A
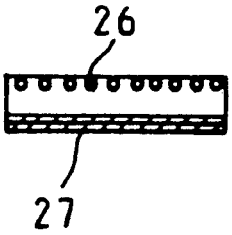
FIG. 4B

DEVICE FOR FACILITATING THE FOLDING OF A RAISABLE CURTAIN

BACKGROUND OF THE INVENTION

The present invention relates to goods-handling doors of the type comprising a raisable curtain, and more particularly to raisable doors that fold concertina-like, comprising a flexible curtain having horizontal reinforcing bars disposed at regular intervals, lifting straps fixed to the bottom bar and passing through rings fixed to at least some of the other bars, and drive means including a shaft disposed above the curtain and onto which the straps are wound. The edges of the curtain and/or the ends of the reinforcing bars are capable of moving in slideways formed in or by lateral uprights which support a top horizontal cross member on which the strap-winding shaft is mounted, possibly together with an electric motor and control members for the motor. It is known that flexible and inextensible means generally in the form of a strip may be provided between adjacent pairs of bars in order to limit the extent to which the bars move apart when the curtain is in its closed position, while not preventing adjacent bars moving towards one another while the curtain is being raised.

One of the problems that arises with a curtain of this nature lies in the folding that takes place when the curtain is raised, both during the raising motion itself and when in the folded position.

When all of the reinforcing bars are provided with rings through which the lifting straps pass, it may happen, e.g. under the influence of wind pressure, that the curtain material folds wrongly going between the bars, and this damages the material and prevents the bars being properly stored side by side in the raised position of the curtain.

Proposals have been made to provide strap-guiding rings on every other bar only. Proper folding is achieved more often in this way, but during curtain-raising, the bundle of bars without rings hangs beneath the bottom bar to which the lifting straps are attached. In the event of unintended wrong operation, a vehicle or a person may strike this bundle of bars or may have it dropped onto them, and the consequences of such an accident may be serious.

An object of the present invention is to solve these two problems.

SUMMARY OF THE INVENTION

The present invention therefore provides a reinforcement device for a vertically raisable curtain door which is foldable concertina-like, the door being of the type comprising a flexible curtain having horizontal reinforcing bars disposed at regular intervals, lifting straps fixed to the bottom bar and passing through guide rings fixed to at least some of the other bars, and a drive unit including a strap-winding shaft, flexible and inextensible means generally in the form of a strip being disposed between each pair of adjacent bars in order to limit the spacing between the two bars of each pair, the device being remarkable in that all of the bars are provided with guide rings through which the straps are passed, and in that the inextensible means have a structure facilitating folding in a preferred direction, e.g. away from the lifting straps.

Preferably, the structure facilitates folding in at least one intermediate zone situated between two end zones, the top end zone being optionally longer than the bottom end zone, each end zone being relatively unfoldable.

In an advantageous embodiment, the inextensible means is made of molded plastic material, and the end zones are formed with longitudinal ribs, whereas the intermediate zone for folding in a preferred direction is weakened by transverse grooves causing the fold to be formed and to extend thereat in the desired preferred direction.

In another embodiment, the structure may be smooth, but the element is molded in the form of the desired fold so that it is deployed under the weight of the curtain to its maximum inextensible length, but returns automatically to the desired folding position when the curtain is raised.

Thus, when the curtain is raised, regular folds are always formed that hang beneath the bottom bar. These folds are light and constitute a shock absorber in the event of wrong operation.

It is also possible to fix a flexible bar, e.g. constituted by a metal wire wound like a coil spring, a short distance beneath the last reinforcing bar to which the lifting straps are attached.

BRIEF DESCRIPTION OF THE DRAWINGS

An embodiment of the invention is described by way of example with reference to the accompanying drawings, in which:

FIG. 2 is a perspective view of one example of a reinforcement device of the invention made of molded plastic;

FIG. 3 is a view analogous to FIG. 2 but applies to a different example;

FIGS. 4A and 4B are section views on lines A-A and B-B of FIG. 3; and FIG. 5 is a fragmentary cross-section through a curtain of the invention in a partially raised position.

DETAILED DESCRIPTION

Figure 1:
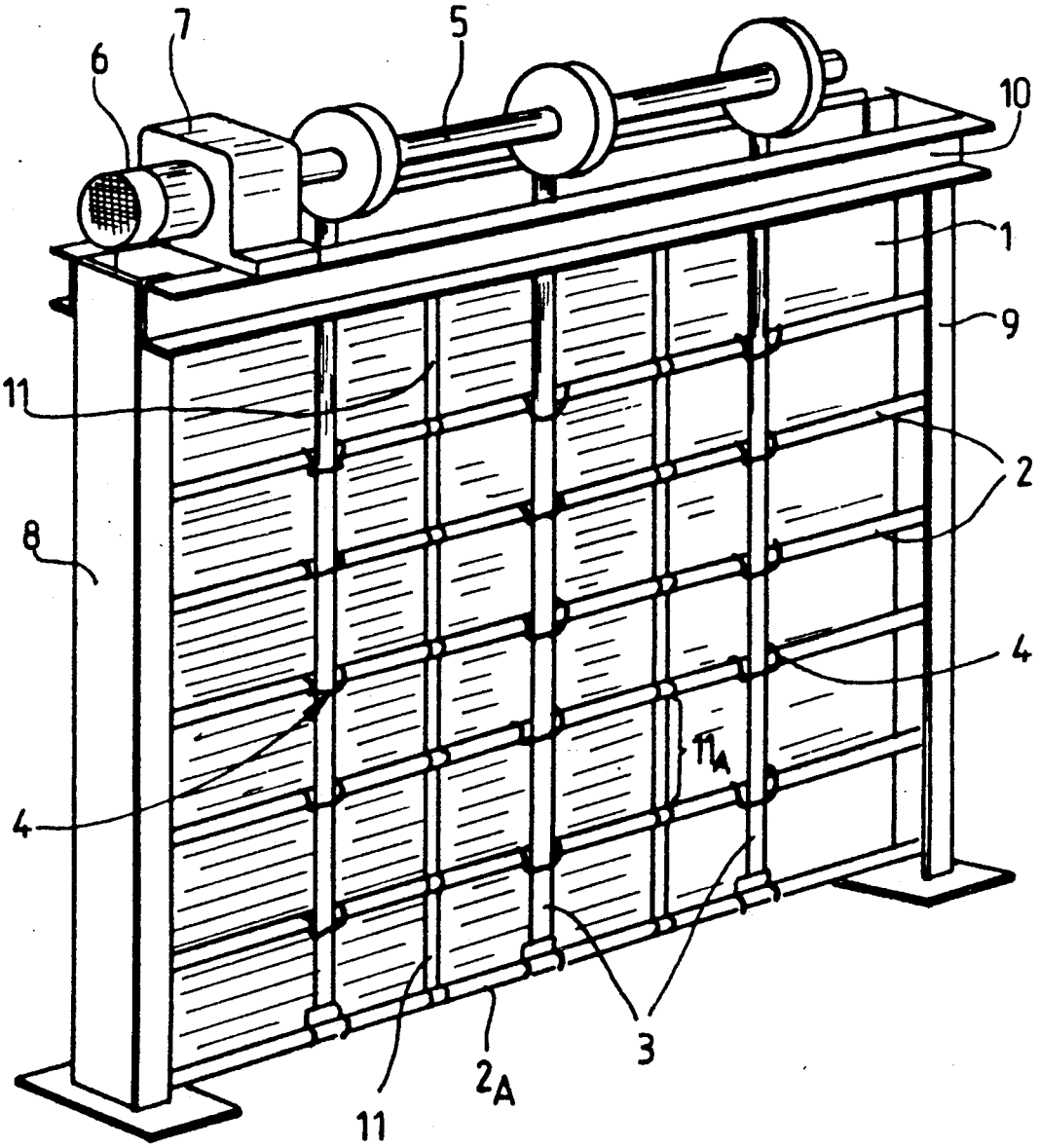
FIG. 1 is a perspective view of an example of a curtain door to which the present invention is applicable.

In order to situate the present invention, FIG. 1 shows a conventional type of curtain door. A curtain 1 is reinforced by horizontal reinforcing bars 2 disposed at regular intervals. Lifting straps 3 are fixed to the bottom bar 2A and pass through rings 4 fixed to the other bars. A drive unit comprises a shaft 5 on which the straps are wound and a motor 6, in practice an electric motor together with a transmission 7. Other components for the end-of-stroke detection, relays, etc., are conventional in this application are not shown. The ends of the bars and possibly also the edges of the curtain move in slideways 8, 9 formed in or constituted by lateral vertical uprights. A top cross-member 10 constituted in this case by two rolled steel girders interconnects the tops of the uprights and supports the shaft 5 onto which the straps are wound. The motor 6, 7 may also be placed on the cross-member. Frequently the curtain 1 is made of flexible non-reinforced plastic material and the weight of the bars (and their inertia) may cause the material of the curtain to be deformed and stretched. That is why reinforcing or "equidistance" straps 11 are provided which are placed against the curtain and fixed to each bar.

When the shaft 5 is winding up the straps, the bottom bar 2A is raised and at consecutive intervals it reaches each successive bar so that it entrains first one, then two, etc., and finally all of the bars upwards. The curtain 1 folds between the bars. If it folds away from the lifting strap 2, then the folds are formed properly, the curtain material is not pinched, and when fully raised, the bars are placed against one another to occupy a relatively small vertical extent at the top of the doorway. However, if the wind or air pressure should thrust the curtain against the lifting straps, then folding takes place badly. The curtain material is pinched and damaged, and when fully raised the bars are kept apart by bundles of badly formed folds. The present invention is designed to avoid this drawback.

In accordance with the present invention, and as shown in FIG. 1, all of the bars 2 are provided with rings 4 for receiving each of the lifting straps 3, and each inter-bar element 11A of the equidistance straps 11 is flexible and inextensible in structure, thereby facilitating folding in a direction away from the lifting straps, each of said equidistance strap elements being fixed to the material of the curtain or being placed on the same side as the lifting straps, with the two ends of each element 11A being fixed to two adjacent bars.

Each element may be constituted, for example, by a thin strip of preformed flexible spring steel which is easily flattened out when the curtain is extended vertically and which curves in the desired direction when the bar beneath it is raised. Alternatively, each element may be constituted by a strip of plastic molded to the shape of the desired fold.

Other examples are shown in FIGS. 2 to 4. In FIG. 2, the equidistance element shown is made of molded plastic material, e.g. polypropylene, polyurethane, polyvinyl chloride, or the like. It is generally in the form of a strip whose ends 11B and 11C are designed to be fixed on adjacent bars, e.g. by means of appropriate sleeves. Its middle portion 15 is intended to form the fold or to direct the fold and on one side (to the front in FIG. 1) it has a smooth surface whereas on its other side it is shaped with transverse grooves or slots 15A that facilitate folding to bring together the two ends by moving them downwards in FIG. 2. In contrast, in the opposite direction, the slot 15A closes and prevents the strip from folding in the wrong direction. The part may additionally be molded with a degree of preshaping or curvature, thereby further facilitating folding in the proper direction. The end zones 16 and 17 of the strip are stiffened by longitudinal grooves or ribs 16A, 17A on one of its two faces, thereby ensuring that the folding shown in FIG. 5 is obtained, which figure is a diagrammatic section through a partially raised curtain. It can be seen that it may be advantageous for the top stiff portion 16 to be longer than the bottom stiff portion 17 on either side of the folding portion 15, given the offsets due to the bars.

Another example is shown in FIGS. 3 and 4. A strip of molded rubber 25 is reinforced over its faces by inextensible fibers, e.g. cables made of steel or rayon. On one face, e.g. the top face, steel cables 26 are embedded in the rubber over the entire length of the strip. On the bottom face, cables 26 are disposed transversely (section BB in FIG. 4B) in the middle zone and they are close together so as to form an incompressible structure, whereas in the end zones (section AA) the cables 28 are disposed longitudinally. The end zones are thus fairly rigid whereas the middle zone is capable of folding in the direction such that its ends are raised, but not in the opposite direction.

At the bottom of the curtain, a small additional piece of curtain may be provided with a flexible reinforcing bar 2A that is not connected to the lifting straps. For example, this bar may be constituted by a coil spring, by a plastic extrusion, etc. It may serve as ballast, as a feeler bar, etc., while remaining flexible.

I claim:

1. A vertically raisable goods-handling door, which is foldable concertina-like, comprising:

a flexible curtain having horizontal bars disposed at regular intervals;

a plurality of lifting straps fixed to the bottom bar and passing through guide rings affixed to the other bars;

flexible and inextensible means, comprising flexible and inextensible elements generally in the form of a strip being disposed between each pair of adjacent bars and being in a substantially flat condition when said curtain is hanging down, for limiting the spacing between said bars and for including folding in said curtain in a direction away from the lifting strap when said curtain is raised; and a drive unit including a strap winding shaft.

2. The vertically raisable goods-handling door according to claim 1, wherein said flexible and inextensible element is formed in a predetermined shape so as to be deployed to its maximum length under the weight of said curtain and to return automatically to the predetermined shape when the door is opened.

3. The vertically raisable goods-handling door according to claim 1, wherein both ends of the flexible and inextensible element include longitudinal reinforcements such as longitudinal grooves or ribs.

4. The vertically raisable goods-handling door according to claim 2, in which the flexible and inextensible element is a strip of flexible preformed spring steel.

5. The vertically raisable goods-handling door according to claim 2, in which the flexible and inextensible element is made from plastic material molded in the predetermined shape.

6. A vertically raisable goods-handling door which is foldable concertina-like, comprising:

a flexible curtain having horizontal bars disposed at regular intervals;

a plurality of lifting straps fixed to the bottom bar and passing through guide rings affixed to the other bars;

flexible and inextensible means, comprising flexible and inextensible elements generally in the form of a strip being disposed between each pair of adjacent bars and being in a substantially flat condition when said curtain is hanging down, for limiting the spacing between said bars and for inducing folding in said curtains in a direction from said lifting straps when said curtain is raised;

a drive unit, including a strap winding shaft; and wherein said flexible and inextensible element has a folding zone intermediate the ends of the element, the folding zone having an inextensible surface structure on one face of the element and an extensible but incompressible surface structure on its other face.

7. The vertically raisable goods-handling door of claim 6, wherein the extensible but incompressible surface structure on the face of said flexible and inextensible element includes transverse slots and grooves, where said extensible but incompressible surface structure of said flexible and inextensible element is located so that folding of said curtain is in a direction away from the lifting straps.

8. The vertically raisable goods-handling door, according to claim 6, wherein said flexible and inextensible element is made of rubber having surface reinforcement in the form of inextensible fibers or threads, one face having transverse reinforcement in the folding zone while the remainder thereof is reinforced by longitudinal elements.

* * * * *

UNITED STATES PATENT AND TRADEMARK OFFICE

CERTIFICATE OF CORRECTION

PATENT NO. : 5,072,767

DATED : December 17, 1991

INVENTOR(S) : Bernard Kraeutler

It is certified that error appears in the above-identified patent and that said Letters Patent is hereby corrected as shown below:

Column 4, line 20, replace "including" with --inducing--.

Signed and Sealed this

Thirtieth Day of March, 1993

*Attest:*

STEPHEN G. KUNIN

*Attesting Officer*

*Acting Commissioner of Patents and Trademarks*